United States Patent [19]

Koschinek et al.

[11] 4,446,299

[45] May 1, 1984

[54] MELT SPINNING OF SYNTHETIC FIBERS

[75] Inventors: Gunter Koschinek, Dietzenbach; Dietmar Wandel, Hanau; Bernd Kretschmann, Kahl; Rolf Zinsser, Heusenstamm, all of Fed. Rep. of Germany

[73] Assignee: Davy McKee Aktiengeseuschaft, Fed. Rep. of Germany

[21] Appl. No.: 500,796

[22] Filed: Jun. 6, 1983

Related U.S. Application Data

[63] Continuation of Ser. No. 264,981, May 18, 1981, abandoned.

[51] Int. Cl.[3] ..... C08G 63/02

[52] U.S. Cl. ..... 528/272; 264/103; 264/176 F; 264/210.8; 528/310; 528/323; 528/336

[58] Field of Search ..... 528/310, 323, 336, 272; 264/103, 176 F, 210.8

[56] References Cited

U.S. PATENT DOCUMENTS

| | | | |
|---|---|---|---|
| 4,035,464 | 7/1977 | Kubitzek et al. | 264/103 |
| 4,092,299 | 5/1978 | MacLean et al. | 528/272 |
| 4,096,226 | 6/1978 | Martin et al. | 264/210.8 X |
| 4,102,965 | 7/1978 | Kubitzek et al. | 264/103 |
| 4,181,697 | 1/1980 | Koschinek et al. | 264/176 F |
| 4,228,120 | 10/1980 | Bromley et al. | 264/176 F X |
| 4,229,500 | 10/1980 | Adachi et al. | 528/323 X |
| 4,237,187 | 12/1980 | Raybon et al. | 264/103 X |
| 4,338,275 | 7/1982 | Carr | 264/176 F |
| 4,338,276 | 7/1982 | Carr | 264/176 F |
| 4,369,155 | 1/1983 | Schilo et al. | 264/210.8 |

*Primary Examiner*—Lucille M. Phynes

*Attorney, Agent, or Firm*—Allegretti, Newitt, Witcoff & McAndrews, Ltd.

[57] ABSTRACT

Improved synthetic spun fibers are disclosed. The fibers have improved properties, especially with respect to the strength-elongation properties, the texturability by means of friction units or gas jet turbulence and the subsequent treatability of the fibers without the interpolation of a separate stretching operation. The fibers are produced from polyester and polyamides.

9 Claims, 4 Drawing Figures

Fig. 3
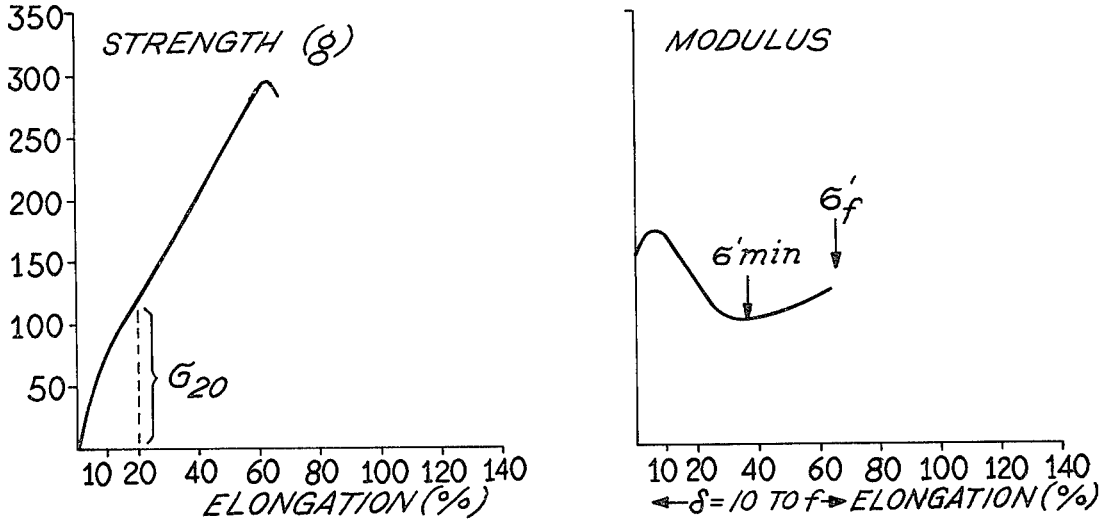
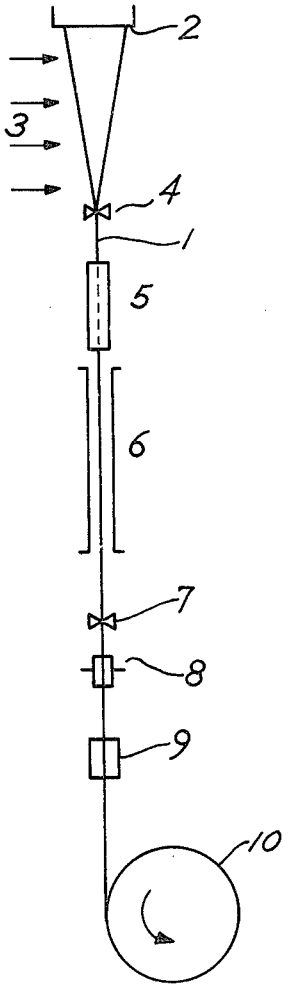
Fig. 4

MELT SPINNING OF SYNTHETIC FIBERS

This application is a continuation of application Ser. No. 264,981, filed May 18, 1981, now abandoned.

BACKGROUND OF THE INVENTION

The invention relates to improved properties of synthetic spun fibers and especially to the mechanical (strength-elongation) properties, the texturability by means of friction units or gas jet turbulence and the subsequent treatability without the interpolation of a separate stretching operation.

Synthetic fibers have been known for a long time and are mass produced. They are produced as synthetic yarn from polymers such as polyester, polyamide 6 or polyamide 66.

The synthetic fibers manufactured from these polymers have, in general, a very low orientation level, low strengths and high elongations at break, as well as inadequate thermal stability. For use in textile finishing of acceptable quality, the synthetic fibers are subjected to a separate stretching process (split process). This process is bothersome; it requires the winding up of the yarns after each operation.

In order to decrease the number of separate operations, integrated fiber stretching processes are also known (Chantry, et al, U.S. Pat. No. 3,216,187). The spun thread is stretched several times its length, without intermediate winding up, directly between rotating godet wheels. This process produces yarns of high strength and low elongations at break, comparable with the yarns from a split process.

In McNamara, et al, U.S. Pat. No. 4,123,492, polyamide 66 yarns are subjected, immediately after the spinning, under definite tension conditions, to a temperature treatment. The tensions are set by means of air turbine-driven rolls running at different speeds. The yarns produced in this way are practically ready-stretched with low elongations at break and specified values of the initial modulus, the 10% modulus and the final modulus.

The additional units required in the fiber stretching complicate the spinning process and finally reach technical limits (stability, temperature constancy) at very high speeds.

In recent times, synthetic fibers have been produced at high draw-off speeds, especially between 2,700 and 4,000 m/min, characterized by a certain degree of pre-orientation (partially oriented yarn/POY). These yarns are particularly suitable for further treatment in a stretch texturing process.

From Plazza et al., U.S. Pat. No. 3,772,872 and Petrille, U.S. Pat. No. 3,771,307, specifications for polyester POY raw yarns are already known which are said to be suitable for "false twist" texturing under special conditions. Noticeable are spinning speeds of $\geqq$2,750 m/min, a birefringence of $\geqq$0.025, elongations at break between 70 and 180% or a boiling shrinkage of 40–60%. The patents give no indication of the friction texturing or the blowing turbulence. The spindle texturing procedures given therein differ in their mode of operation (friction behavior, tensions before and after the spindle) basically from the mentioned newer processes, which are carried out at considerably higher texturing speeds.

Because of the elongation limitation to $\geqq$70% or the boiling shrinkage between 40–60%, these synthetic fibers are not usable for direct textile applications. Under mechanical and thermal stress the finished fabric is not stable. It is under these circumstances that the present invention was conceived.

SUMMARY OF THE INVENTION

It is an object of the present invention to provide synthetic spun fibers which are spun without a godet wheel, drawn off and wound up at speeds of 4,000 to 6,200 m/min, have a tension at 20% elongation $\sigma_{20}$ of $\geqq$0.55 g/dtex and an elongation at break <75%, which further have a boiling shrinkage of less than 20% and a permanent elongation of $\leqq$10%, respond to the following modulus elongation characteristic $\sigma(\delta)$:

(a) For an elongation $\delta \geqq 10\%$, the modulus is $\sigma'(\delta) \geqq 0$;

(b) the minimal value of the modulus in the elongation range $\delta = 10\%$ up to breaking elongation $\delta_f$ (with $\delta_f$ representing the elongation at the break of the 1st capillary) is called $\sigma'_{min}$ and is $\geqq$0; and (c) the difference $(\sigma'_f - \sigma'_{min}) \div \sigma'_f \geqq 0$ and are especially suitable for treatment in friction stretch texturing and a gas jet turbulence process with speeds $\geqq$550 m/min, as well as for processing into fabrics and knits without the interpolation of a separate stretching operation.

In particular, if there permanent elongation (at 20 cN/tex stress) $\leqq$2% and their hot air shrinkage (at 160° C.) under a stress of 2 cN/tex amounts to $\geqq$0, these yarns as "not drawn yarns" are suitable, without the interpolation of a separate stretching stage, for applications that place high demands on the mechanical and thermal stability.

The above-specified characteristic data of synthetic spun fibers had previously not been achieved by POY yarns. The characterization of a positive hot air shrinkage under stress should be separated from an elongation of the fiber such as occurs generally in traditional POY. The tension at 20% elongation, the low boiling shrinkage and the low elongation at break together with the modulus elongation characteristic meet the changed requirements for the yarns in the friction texturing process or the turbulence process and basically go beyond what is required in the spindle texturing process.

Another object of the present invention is to provide raw yarns which can be treated under considerably higher texturing speeds $\geqq$550 m/min in comparison with spindle processes which have speeds of $\leqq$160 m/min. The speed at which the raw yarn can be treated in a friction unit is limited only by the maximum speed of the unit itself, and can reach up to 6,200 m/min with turbulence units. Turbulence units can be used in a stage in the spinning process, but can also be applied in a separate stage as a blowing texturing unit.

It is known that in friction texturing, under the friction stress, abrasion occurs on the yarn, resulting in dust that consists in part of polymer dust. Because of the special structure of the yarn based on the present invention, the resistance is obviously enhanced. The result is that fewer operating disturbances occur. In turbulence units, the positive effect of these yarns is explained by the elasticity factor, determined by the fiber structure.

A further object of the present invention is to provide synthetic fibers which can also be processed directly into fabrics and knits without the intercalation of a separate stretching stage. Such "not drawn yarns" can therefore be produced, according to the invention, at considerably lower speeds than heretofore customary.

Yet another object of the present invention is to provide a godet wheel-less production of synthetic fibers such that no form-locking elongation of the synthetic fibers by means of rotating elements (gas turbines, rolls, godet wheels) is used for the build-up of thread tension or stretching tension in the spinning. These yarns thereby distinguish themselves from yarns which are spin-stretched. With godet wheel-less spinning there exists, rather, the contrary problem. Due to the fiber-air friction, friction forces, occuring in the cooling and spinning compartment, lead to an increase in the spinning tension, which can negatively affect the winding up of the synthetic fibers. A good yarn package build-up requires, in general, a winding tension of $\leqq 0.15$ g/dtex. The synthetic fiber is therefore preferably bundled or provided with a special preparation, or treated with gas currents in the running direction, so that the spinning tensions are reduced to the necessary degree for the correct winding up.

It is known that the speed is a measure for the development of the fiber structure in the synthetic fiber. The use of extremely high speeds $\geqq 6{,}400$ m/min in the state of the art for the production of hard yarns leads on the other hand to difficult running problems (high rate of fiber breakage) which make such processes questionable. The speed limitation as provided by the present invention has thus the obvious effect of considerably favoring the running security of the process.

The speed is only an indirect characteristic magnitude for the determination of the fiber orientation. Beck describes, in the article "Orientation and Fiber Strengths in the Spinning of Fibers from the Melt Under Free and Forced Convection", in Colloid and Polymer Science, Vol. 258, No. 1, 1980, pages 27 to 41, how a direct relationship exists between speed and the heat conductivity number. It is thus obvious to an air engineer what measures he is to take in order to obtain a good heat conductivity effect under constant fiber speed. Thereby the means for the setting of any desired orientation magnitude is given. In contrast to traditional spinning processes, under the present invention, the delay in the cooling off of the fibers after leaving the spinneret is done away with.

In the subsequent processing of the "not drawn spun fiber" it is important, for certain areas of use, that the permanent elongation be low and that the hot air shrinkage under stress have a value $\geqq 0$. Herein also, these yarns are differentiated from POY, which have a higher permanent elongation and show a lengthening in heat under stress. These yarns are not suitable, e.g., for a heat treatment on the tentering frame, where they lead to process troubles. Also, they are characterized by a deficient cold form stability.

Still another object of the invention is to provide raw yarns which are suitable for the areas of use indicated herein. It is surprisingly seen that the extremely high production speeds are not necessary for the production of hard yarns. Even at moderate speeds, yarn properties can be incorporated that alllow subsequent processing without the interpolation of a separate stretching operation. Yarns with $\sigma_{20} < 1.50$ g/dtex are preferably used for the friction texturing and turbulence, yarns with $\sigma_{20} \geqq 1.50$ g/dtex preferably for the "not drawn application".

The properties of the spun fibers of the present invention were determined by the following methods:

(a) Strength-elongation properties:

These were determined from the spun fiber on commercial breaking equipment (INSTRON) by plotting of the strength-elongation graph. The breaking strength and elongation at break, the tension at 20% elongation, $\sigma_{20}$ (g/dtex), the modulus function $\sigma'(\delta)$, and the characteristic magnitudes $\sigma'_{min}$ and $\sigma'_f$ were taken graphically from the graphs or called up directly through a computer.

(b) Permanent elongation (at 20 cN/tex stress):

A fiber strand of denier 1,250 dtex was produced which was under a stress of 2.5 kg and underwent a relative stress of 20 cN/tex. Before the stressing, the length of the strand $L_0$ was measured under a weight of 2.5 p. Then the strand was subjected 10 sec at room temperature (22° C./65%) to the 2.5 p weight. Then the weight of 2.5 p was again applied and the length $L_1$ measured after an additional 10 sec. The permanent elongation was then calculated at $$\frac{L_1 - L_O}{L_O} \times 100\%.$$

(c) Boiling shrinkage:

On a strand of 2,500 dtex, the length $L_1$ was determined under the relative stress of 0.1 cN/dtex. Then the strand was put without stress for 10 minutes into boiling water. There then followed a conditioning of at least a half hour before the length $L_2$ was again measured under the above stress. The boiling shrinkage was then calculated at $$\frac{L_1 - L_2}{L_1} \times 100\%.$$

(d) Hot air shrinkage (under stress of 2 cN/tex):

On a strand of denier 1,250 dtex, the length $L_1$ was measured under stress of 2 cN/tex. The strand was then exposed, under maintenance of the strand stressing, for 10 min to a temperature of 160° C. in a circulating air drying cabinet. There then followed a conditioning of at least a half hour before the length $L_2$ was again measured under stress. The hot air shrinkage is then calculated at $$\frac{L_1 - L_2}{L_1} \times 100\%.$$

These and other objects, advantages and features of the invention will be set forth in the detailed description which follows.

BRIEF DESCRIPTION OF THE DRAWINGS

FIG. 3 shows a strength-elongation graph and the modulus function for a polyamide 66 spun fiber that lies within the specified characteristic data. The difference $(\sigma'_f - \sigma'_{min}) \div \sigma'_f$ is 18%.

FIG. 4 shows schematically a spinning system for the production of the fibers in accordance with the invention.

DETAILED DESCRIPTION OF THE PREFERRED EMBODIMENT

Figure 1:
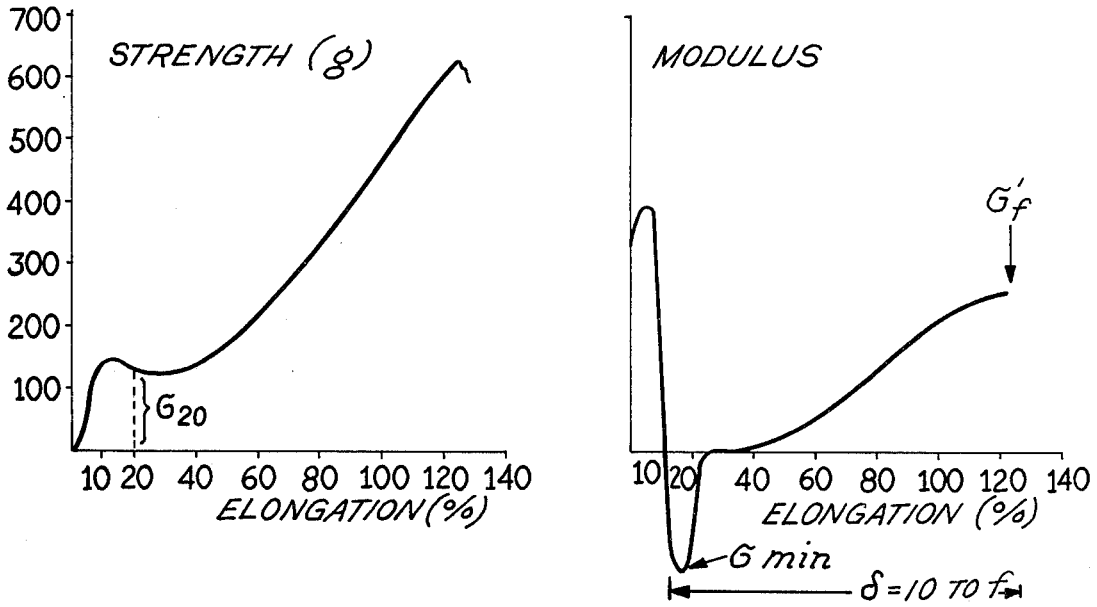
FIG. 1 shows a strength-elongation graph and the modulus function for a polyester (PES) spun fiber which lies outside of the characteristic data specified by the present invention. It should be recognized that this fiber, which is drawn off at 3,500 m/min, has a very low $\sigma_{20}$ value and that the negative minimum $\sigma'_{min}$ of the modulus function at about 15% elongation is thus within the range $\delta = 10$ to f (f being the amount of elongation at break).
Figure 2:
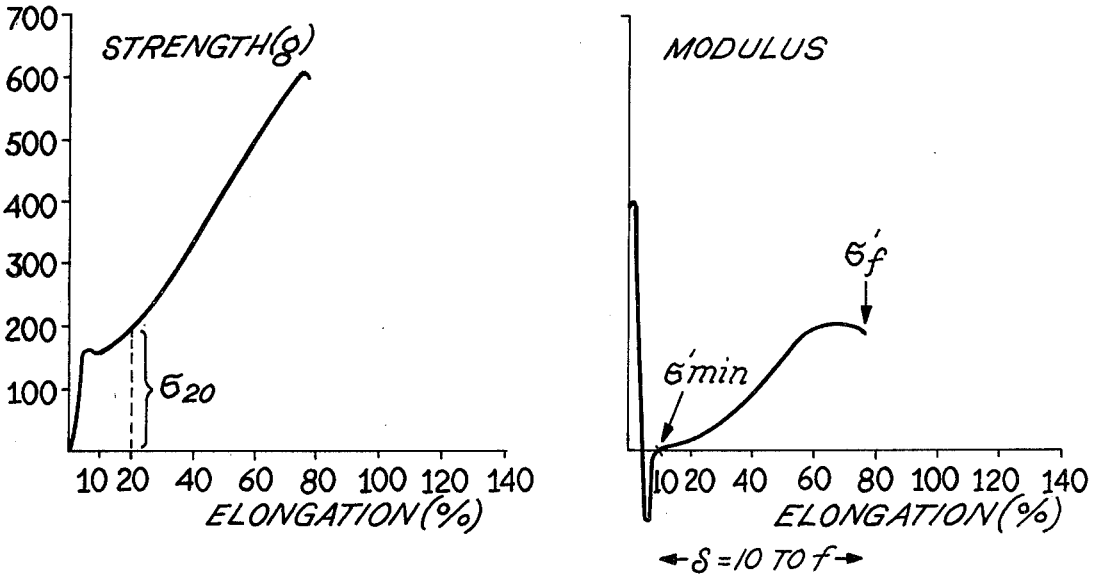
FIG. 2 shows a strength-elongation graph and the modulus function for a PES spun fiber that lies within the specified characteristic data. $\sigma'_{min}$, which is in the range $\delta = 10$ to f, is positive such that $\sigma'_f - \sigma'_{min} \geqq 0$.

The melt is forced through a spinneret 2 with the appropriate number of orifices. The melt fibers 1 are cooled by air blast 3 and then run through the fiber bundling guide 4, a frictional tension-increasing device 5, and the conditioning zone 6, which can be either heated or unheated and/or charged with a gaseous medium such as air or steam. The fibers are then led via the fiber guide 7 to a preparation device 8, through a detensioning device 9, which is mechanically driven or operated aerodynamically, and finally are led to the reeling unit 10.

The cooling of the fiber underneath the spinneret is especially important. The fiber temperature must be below the adhesive limit before reaching the fiber guide 4. The distance from the fiber guide to the spinneret is most advantageously between 400 and 1,500 mm.

The cooling speed, however, also has an influence on structure. By means of the dependency between heat conduction number and speed, a quite definite structural range is set by the application of the specified speed range. In particular, a delay in the cooling is avoided.

The frictional tension-increasing device can be adjusted over wide ranges with known means. The fiber-air friction at high spinning speed alone can lead to a build-up of tension in the fiber running direction. Also, however, stationary friction elements can be used around which the fiber goes at a definite angle. Likewise this element can be designed as a jet for the introduction of air at a correspondingly high speed.

From the article by Hamana, "The Process of Fiber Formation in Melt Spinning", in Melliand Textilberichte 4, 1969, page 385, it is known that the magnitude of the spinning tension is a measure for the fiber orientation that is created in the fiber.

The conditioning zone 6, which can also coincide with 5, makes it possible to influence the thermal properties of the fiber in a desired manner. Thus, somewhat higher temperatures in this zone give fibers with lower boiling shrinkage, as well as lower hot air shrinkage.

The preparation device applies to the fiber, in a known manner, a film with an oily substance to influence the fiber adhesion and the treatability properties.

Finally, in the detensioning device 9, the fiber tension is lowered to the point where perfect, bulge-free reeling can take place. The tension here should be set at value $\leqq 0.15$ g/dtex.

The present invention can be better understood upon consideration of the following examples:

EXAMPLES 1-5

Polyester of the relative solution viscosity $n_{intr}=0.64$ melted in the spinning system and forced at the rate of 92 g/min through 32 orifices in a spinneret. The melted fibers were cooled by a horizontally flowing air blast at a speed of 0.4 m/sec. The first fiber guide was located at a distance of 450 mm from the spinneret. Devices 5 and 6 were operated without mechanical elements or electric heating, so that only the air carried along from the set fiber bundle on the basis of the injector principle had an effect on the setting of the spinning tension. The spinning tension in relation to the speed was 3,500 m/min, spinning tension=0.17 g/dtex
4,500 m/min, spinning tension=0.35 g/dtex
5,000 m/min, spinning tension=0.45 g/dtex
5,500 m/min, spinning tension=0.50 g/dtex
6,000 m/min, spinning tension=0.65 g/dtex.

The preparation took place conventionally, before the yarns were reeled, at speeds of 4,500, 5,000, 5,500, 6,000 and 3,500 m/min. In each case full bobbins weighing 12 kg were produced. The characteristic data of the yarns are set forth in TABLE 1.

The yarns of Examples 1-4 came within the specifications of the invention. These yarns showed very good running properties with the use of the friction unit texturing at 600 m/min working speed. This was on a production machine available on the market. Also a blast turbulence produced new types of bulky yarns at 1,100 m/min with smooth and voluminous touch without running problems.

In Examples 3 and 4, the turbulence device was mounted at position 9 in FIG. 4, which led to a trouble-free operation. The use of the yarns of these two examples in weaving for the clothing sector was problem-free. Tenter frame fixation was carried out without any difficulty.

The yarn of example 5 failed on the tenter frame. Its deficiency was characterized by a flabby touch. Its permanent elongation of 11.4% was excessively high, and the hot air shirnkage under stress was negative, i.e., fiber elongation occurred. These specifications were outside of the limits of the invention.

EXAMPLES 6-7

Polyester spun fibers were produced as in Examples 1 to 5, but with the difference that a delivery of 34 g/min was forced through 24 orifices of a spinneret and that air was blown in the tension device 5, with the fibers being drawn off at the constant speed of 4,500 m/min. Thereupon, spinning tensions of 0.46 and 0.37 g/dtex, respectively for examples 6 and 7, were set up. These yarns were further processed without problem as "not drawn yarns". Further characteristic data are set forth in TABLE 1.

EXAMPLES 8-11

Polyamide 66 having a relative solution viscosity $n_{rel}=2.5$ was melted in a spinnig system and forced at the rate of 38 g/min through 32 orifices of a spinneret. The fibers were cooled by a current of air blown horizontally at 0.3 m/min. The first fiber guide was located at a distance of 400 mm from the spinneret. Devices 5 and 6 were operated without mechanical elements and without electrical heat, so that only the air injected by from the set fiber bundle had any effect on the spinning tension. The spinning tension in relation to the speed was 3,900 m/min, spinning tension=0.37 g/dtex
5,000 m/min, spinning tension=0.72 g/dtex
5,500 m/min, spinning tension=0.88 g/dtex
6,000 m/min, spinning tension=1.05 g/dtex.

The preparation was done conventionally, before the yarns were reeled, at speeds of 5,000, 5,500, 6,000, as well as 3,900 m/min. Full bobbins weighing 12 kg were produced trouble-free. The characteristic data of the fibers are set forth in TABLE 2.

The yarns of Examples 8-10 came within the scope of the invention. These yarns showed a problem-free running under application of the friction unit texturing at 900 m/min working speed. Also a blast turbulence at 1,100 m/min produced new-type yarns without running problems.

Yarns of Examples 9–10, in which $(\sigma_f - \sigma'_{min}) \div \sigma'_f = 0$, were fabricated "not drawn" into fabric and knits without any problems.

The yarn of Example 11 failed on the tenter frame and led to manufacturing problems in both weaving and knitting, with the goods proving to be very form-unstable because of the high permanent elongation and the negative hot air shrinkage (lengthening). The speed of this example was outside the specified range of the present invention.

EXAMPLE 12–13

Polyamide 66 fibers were produced as in Examples 8–11, but with the difference that a delivery of 19.5 g/min was forced through 16 orifices of a spinneret and that air was blown in the tension device 5, with the fibers being drawn off at the constant speed of 4,500 m/min. Thereby, for these examples, spinning tensions of 0.68 and 0.57 g/dtex, respectively, were set up. These yarns were characterized by high $\sigma_{20}$ values, as well as by a ratio of $(\sigma'_f - \sigma'_{min}) \div \sigma_f = 0$. These yarns were able to be utilized "not drawn" in both knitting and weaving without any problems.

It should be understood that the foregoing disclosure emphasizes certain specific embodiments of the invention and that all modifications or alternatives equivalent thereto are within the spirit or scope of the invention as set forth in the appended claims.

TABLE 1

Specifications of Polyester (PES) Fibers Described in the Examples

| Example No. | | 1 | 2 | 3 | 4 | 5 Comparison | 6 | 7 |
|---|---|---|---|---|---|---|---|---|
| Polymer | | PES | → | → | → | → | → | → |
| Spinning speed | (min/min) | 4500 | 5000 | 5500 | 6000 | 3500 | 4500 | 4500 |
| $\sigma_{20}$ | (g/dtex) | 1.0 | 1.4 | 1.8 | 2.3 | 0.48 | 3.4 | 2.8 |
| $\sigma'$ ($\delta$ = 10 to f) | | ≧0 | ≧0 | ≧0 | ≧0 | <0z.T. | ≧0 | ≧0 |
| $\sigma_{min}'$ ($\delta$) | | >0 | >0 | >0 | >0 | <0 | >0 | >0 |
| $\sigma_f'$ ($\delta$) | | >0 | >0 | >0 | >0 | >0 | >0 | >0 |
| $\frac{\sigma_f' - \sigma_{min}'}{\sigma_f'} \cdot 100$ | (%) | >0 | >0 | >0 | >0 | >0 | 0 | 0 |
| Spinning denier | (dtex) | 211/32 | 191 | 174 | 155 | 270 | 77/24 | 77/24 |
| Breaking Strength | (g/dtex) | 2.9 | 3.1 | 3.3 | 3.6 | 2.2 | 4.1 | 3.8 |
| Elongation at Break | (%) | 74 | 69 | 64 | 56 | 126 | 24 | 34 |
| Boiling shrinkage | (%) | 4.5 | 5.5 | 6.5 | 6.5 | 55 | 3.8 | 7.0 |
| Permanent extension | (%) | 10 | 9 | 8 | 6 | 19 | 0.5 | 1.8 |
| Hot air shrinkage under stress | (%) | — | — | 0.5 | 0.8 | <0 | 1.2 | 1.6 |
| Friction texturing-Speed | | 600 | 600 | 600 | 600 | — | — | — |
| Friction texturing-Result | | good | good | good | good | | | |
| Turbulence-Speed | | 1100 | 1100 | 5500 | 6000 | — | — | — |
| Turbulence-Result | | good | good | good | good | | | |
| Not Drawn-Result | | — | — | good | good | negative | good | good |

TABLE 2

Specifications of Polyamide 66 (PA66) Fibers Described in the Examples

| Example No. | | 8 | 9 | 10 | 11 Comparison | 12 | 13 |
|---|---|---|---|---|---|---|---|
| Polymer | | PA 66 | → | → | → | → | → |
| Spinning speed | (min/min) | 5000 | 5500 | 6000 | 3900 | 4500 | 4500 |
| $\sigma_{20}$ | (g/dtex) | 1.45 | 1.5 | 1.55 | 1.0 | 2.8 | 2.5 |
| $\sigma'$ ($\delta$ = 10 to f) | | ≧0 | ≧0 | ≧0 | ≧0 | ≧0 | ≧0 |
| $\sigma_{min}'$ ($\delta$) | | >0 | >0 | >0 | >0 | >0 | >0 |
| $\sigma_f'$ ($\delta$) | | >0 | >0 | >0 | >0 | >0 | >0 |
| $\frac{\sigma_f' - \delta_{min}}{\sigma_f'} \cdot 100$ | (%) | 18 | 0 | 0 | >0 | 0 | 0 |
| Spinning denier | (dtex) | 77/32 | 72 | 65 | 95/32 | 44/16 | 44/16 |
| Breaking Strength | (g/dtex) | 3.1 | 3.3 | 3.45 | 2.6 | 4.5 | 4.3 |
| Elongation at Break | (%) | 72 | 67 | 58 | 100 | 40 | 44 |
| Boiling shrinkage | (%) | 4.5 | 5.0 | 5.7 | 4.3 | 6.6 | 6.2 |
| Permanent extension | (%) | 8 | 7 | 6 | 11.4 | 1.5 | 1.7 |
| Hot air shrinkage under stress | (%) | — | 1.8 | 1.5 | <0 | 1.0 | 1.2 |
| Friction texturing-Speed | | 900 | 900 | 900 | — | — | — |
| Friction texturing-Result | | good | good | good | | | |
| Turbulence-Speed | | 1100 | 1100 | 1100 | — | — | — |
| Turbulence-Result | | good | good | good | | | |
| Not Drawn-Result | | — | good | good | negative | good | good |

We claim as our invention:

1. Improved synthetic spun fibers suitable for raw yarns for a friction unit texturing process or a gas jet turbulence process as well as for fabrication as "not drawn yarns" into fabrics and knits without the interpolation of a separate stretching operation, said synthetic fibers being characterized by a tension at 20 percent elongation ($\sigma_{20}$) of greater than or equal to 0.55 g/dtex, by a boiling shrinkage of less than 20 percent, by a permanent elongation of less than or equal to 10 percent, and by a modulus ($\sigma'(\delta)$), said modulus being characterized by $\sigma'(\delta)$ greater than or equal to zero for an elongation ($\delta$) of greater than or equal to 10 percent, by a minimum value ($\sigma'_{min}$) in the elongation range of $\delta = 10$ to breaking extension f, said breaking extension f representing the elongation at the rupture of the first capillary, said minimum value ($\sigma'_{min}$) being greater than or equal to zero, and characterized by the difference $(\sigma_{f\sigma}' - \sigma_{min}) \div \sigma'_f$ being greater than or equal to zero, wherein f is the value of the final modulus at said rupture.

2. Synthetic fibers, as claimed in claim 1, wherein said fibers are spun without a godet wheel and are drawn off and reeled at speeds of greater than 4,500 and less than or equal to 6,200 meters/min.

3. Synthetic fibers, as claimed in claim 1, wherein said synthetic fibers are made from polyamide.

4. Synthetic fibers, as claimed in claim 3, wherein said minimum value of said modulus ($\sigma'_{min}$) is at an elongation ($\delta$) of greater than or equal to 30 percent.

5. Synthetic fibers, as claimed in claim 1, wherein said synthetic fibers are made from polyester.

6. Synthetic fibers, as claimed in claim 5, wherein said minimum value of said modulus ($\sigma'_{min}$) is at an elongation ($\delta$) of greater than or equal to 30 percent.

7. Synthetic fibers, as claimed in claim 1, wherein $$\frac{(\sigma_f' - \sigma_{min}')}{\sigma_f'} \times 100$$

is less than or equal to 20 percent.

8. Synthetic fibers, as claimed in claim 1, wherein $$\frac{(\sigma_f' - \sigma_{min}')}{\sigma_f'} \times 100$$

is equal to zero.

9. Synthetic fibers, as claimed in claim 1, wherein said fibers are form yarns, said yarns being especially suitable as "not drawn yarns" for further handling without the interpolation of a separate stretching operation, said fibers being characterized by a tension at 20 percent elongation ($\sigma_{20}$) of greater than or equal to 1.5 g/dtex, by an elongation at break of less than or equal to 68 percent, by a boiling shrinkage of less than or equal to 8 percent, by a permanent elongation of less than or equal to 2 percent, and by a hot air shrinkage under stress of greater than or equal to zero.

* * * * *